United States Patent [19]

Nicholson et al.

[11] Patent Number: 4,508,301

[45] Date of Patent: Apr. 2, 1985

[54] SHELF SUPPORT

[76] Inventors: Timothy J. H. Nicholson, Rectory Cottage, Sulhamstead Abbots, Reading, Berkshire; Andrew L. Lee, 10, Brunswick Rd., Kingston-upon-Thames, Surrey; Clifford Roberts, 11, Bathurst Ave., Merton Park, London SW 19, all of England

[21] Appl. No.: 566,286

[22] Filed: Dec. 28, 1983

[30] Foreign Application Priority Data

Sep. 30, 1983 [DE] Fed. Rep. of Germany ... 8328175[U]

[51] Int. Cl.[3] ..... A47G 29/02; E04G 3/08

[52] U.S. Cl. ..... 248/250; 211/90; 248/235

[58] Field of Search ..... 248/235, 243, 250; 211/90; 108/106, 107, 108, 110

[56] References Cited

U.S. PATENT DOCUMENTS

| | | | |
|---|---|---|---|
| 2,316,053 | 4/1943 | Davis | 248/246 UX |
| 2,477,771 | 8/1949 | Sanford | 248/247 |
| 3,034,757 | 5/1962 | Suben | 248/235 |
| 3,437,214 | 4/1969 | Sainsbury | 211/90 |
| 3,730,468 | 5/1973 | Magnusen | 108/108 X |
| 3,994,462 | 11/1976 | Shine | 248/248 |
| 4,385,565 | 5/1983 | Roberts | 248/235 X |
| 4,407,476 | 10/1983 | Bohannan | 248/235 |

FOREIGN PATENT DOCUMENTS

| | | | |
|---|---|---|---|
| 118993 | 6/1947 | Sweden | 248/235 |
| 139686 | 3/1953 | Sweden | 211/90 |
| 1126253 | 9/1968 | United Kingdom . | |
| 1222488 | 2/1971 | United Kingdom | 248/243 |
| 1540224 | 2/1979 | United Kingdom | 248/250 |

*Primary Examiner*—J. Franklin Foss

*Attorney, Agent, or Firm*—Larson and Taylor

[57] ABSTRACT

In a shelf support formed as a continuous section and capable of supporting a shelf as a cantilever by the cooperation of: a supporting member to lie below and in contact with said shelf, said supporting member being disposed upon a plate for fixing to a wall; and a retaining member to lie above and in contact with said shelf, said retaining member being disposed upon said plate; the improvement comprising, locating a region of said retaining member, spaced from said plate, closer to said supporting member than a region of said retaining member adjacent said plate and providing a ramp surface to urge the retaining member upwards, whereby the shelf is gripped between the supporting member and the retaining member and wherein the supporting member is in contact with the shelf at at least a first location and at least a second location, said second location being closer to said plate than said first location.

15 Claims, 3 Drawing Figures

SHELF SUPPORT

BACKGROUND OF THE INVENTION

The present invention relates to an elongate, continuous section shelf support for supporting a rectangular section shelf and holding it as a cantilever, the shelf support being formed as a continuous section to run at least part of the length of the rear portion of the shelf, and having support means disposed to engage the rear portion only of the underside of the shelf and retaining means disposed to engage the rear portion of the top of the shelf, whereby the shelf can be frictionally engaged between the support surface and the retaining surface. Normally, there will be parts of the support which extend respectively up above the retaining surface and down below the support surface, to give bracing against an upright surface such as a wall when the shelf support is mounted thereon.

GB No. 2 053 666B discloses a shelf support of this general type. In practice, the shelf support functions very well provided the thickness of the shelf is within fairly fine tolerances. However, it is found expensive to maintain fine tolerances in manufacture, and if customers use their own shelving, the shelving is often outside the required tolerances. It is therefore desirable to improve the shelf support so that it can accept shelving of greater thickness tolerances.

THE INVENTION

The forward edge of the retaining means is the lowest part of the retaining means, and the support means has a dip below the forward edge of the retaining means, to enable the rear of the shelf to be engaged beneath the forward edge of the retaining means with the front of the shelf slightly raised, prior to pushing the shelf home.

By arranging that the forward edge of the retaining means is the lowest part of the retaining means, and by providing the dip in the support means below the forward edge of the retaining means, or the equivalent of such a dip, a somewhat thicker shelf can be inserted between the dip and the forward edge of the retaining means by slightly lifting the forward edge of the shelf, for instance through about 5°; once the shelf has been inserted, it can be pushed firmly home, the extra thickness being taken up by the forward edge of the retaining means flexing upwards and possibly the forward edge of the retaining means biting slightly into the shelf; also, if a detent is provided on the support means, the detent may bite further into the underside of the shelf. For instance, in this way, it is found that a shelf support which is designed for a 15 mm thick shelf can comfortably accept 15.5 mm thick or even 16 mm thick shelves.

PREFERRED EMBODIMENTS

The invention is further described, by way of example, with reference to the accompanying drawings, in which.

FIGS. 1 AND 2

Figure 2:
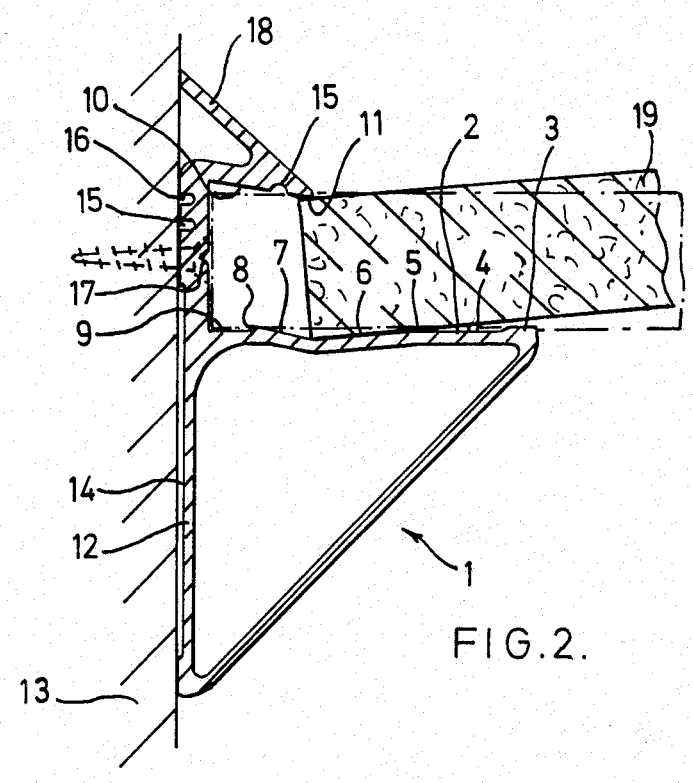
FIG. 2 is a vertical section along the plane II—II in FIG. 1, on a smaller scale, showing the insertion of a shelf.

As shown in FIG. 2, an elongate, uniform and continuous section shelf support 1 is of unitary construction. The shelf support 1 has a braced, roughly horizontal support means in the form of a member defining a support surface 2 which has the following zones, going from front to rear: a front lip 3, a horizontal zone 4, a curved transition zone 5, a dip zone 6, a ramp or wedge zone 7 (acting as wedge means) providing a wedge surface inclined at a small angle to the horizontal, a small downwards step 8 and a horizontal rearmost zone 9. The transition zone 5 forms a smooth curve between the horizontal zone 4 and the dip zone 6. The rearmost zone 9 is below the level of the rear end or edge of the wedge zone 7, which is in turn at the same level as the front lip 3. The dip and wedge zones 6,7 meet at a large obtuse angle and form a dip, the angles of the zones to the horizontal preferably being respectively 5° and 11°. In effect, the support surface 2 provides spaced first and second support locations or parts (lip 3 and the rear edge of the wedge zone 7) at the same level.

The shelf support 1 also has retaining means in the form of a member defining a roughly horizontal retaining surface 10 which is inclined forwards and downwards so that its downwardly extending forward part or edge part 11 is its lowest part. The retaining surface 10 is preferably substantially parallel to the rear zone 7, and may be for instance inclined at 10° to the horizontal.

The vertical distance between the edge part 11 and the front end of the wedge zone 7 is greater than the vertical distance between the edge part 11 and the rear end of the wedge zone 7 or the lip 3.

The support 1 has mounting means in the form of a rear plate 12 which has a rear surface for abutting against an upright surface 13 such as wall, and is rebated at 14 to improve seating against an irregular surface. The grooves 15 are for metal saving, but the groove 16 imparts some flexibility at the junction of the retaining surface 10 and rear plate 12. The rear plate 12 carries the support means and the retaining means.

The support 1 can be screwed in position, and a small locating groove 17 is provided for drilling the screw holes. When in position, the lowest part of the rear plate 12 and the top of an upward extension 18 give bracing against the surface 13, preventing the gap between the support surface 2 and the retaining surface 10 being opened up excessively if a large weight is carried by the shelf 19.

The support surface 2 and the retaining surface 10 define a gap for receiving the rear portion of a shelf. As shown, a slightly over-thickness rectangular section shelf 19 can be inserted with its forward edge slightly raised; as its rear bottom edge will be beneath the level of the horizontal upper zone 4 of the support surface 2, the thickness of the shelf 19 can be slightly above that specified. When the shelf 19 is pushed firmly home, the retaining surface 10 will flex slightly upwards to accommodate the extra thickness of the shelf 19. When this occurs, the top of the extension 18 may bite into the surface 13 and/or may slide up the surface 13, possibly with some dishing of the extension 18; thus the edge part 11 is movable upwards by the application of a substantial vertical force. The wedging action applies strong forces; an upwards force applied to the edge part 11 has a relatively large lever arm on the join between the retaining surfaces 10 and the rear plate 12. In addition to the movement of the edge part 11, the step 8 may bite further into the underside of the shelf 19. The shelf 19 will be gripped or frictionally engaged between the support surface 2 and the retaining surface 10 and locked in position by the step 8 which acts as a retaining detent or barb. The front lip 3 may very slightly indent the underside of the shelf 19 when pressure is applied to the top of the shelf 19. The lip 3 provides a narrow support zone and avoids difficulties that could be caused by small irregularities on the underside of the shelf 19. The support 1 is designed so that the shelf 19 assumes a roughly horizontal position. In position, the rear of the shelf 19 will be against the rear plate 12. In theory at least, only the forward edge part 11 of the retaining surface 10 is necessary, unless very severe loads are applied; however, the rear part of the retaining surface 10 determines an upper limit to the thickness of the shelf 19, when the whole of the surface 10 is flush against the top of the shelf 19. The resistance of the edge part 11 is sufficient to support normal loads, and in practice the main purpose of the bracing extension 18 is to prevent the retaining surface 10 flexing upwards significantly if the front of the shelf 19 is raised (when the lever arm on the edge part 11 would be greater).

Figure 1:
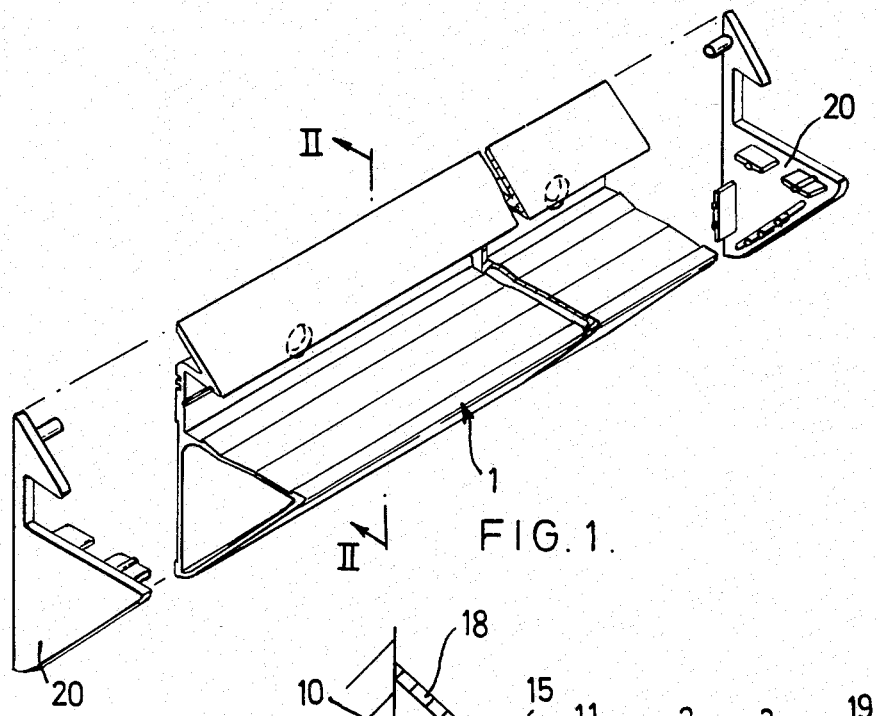
FIG. 1 is an exploded, isometric view of a first shelf support of the invention together with two end pieces.

As shown in FIG. 1, decorative plastics-material end pieces 20 can be provided for push-fitting into the ends of the shelf support 1.

General dimensions of the shelf support 1 and shelf 4 and material or alternative materials for their construction can be as in GB No. 2 053 666B, which also gives other useful information. Preferably, the shelf support 1 is extruded from aluminium or plastics material or rolled from sheet metal strip. The support surface 2 will normally project from the rear plate 12 less than 50% or less than 30% of the shelf width, and may project as little as about 10% of the shelf width. The support 1 will normally have a length of 300 mm or greater, i.e. a substantial extent along the rear of the shelf 19.

FIG. 3

Figure 3:
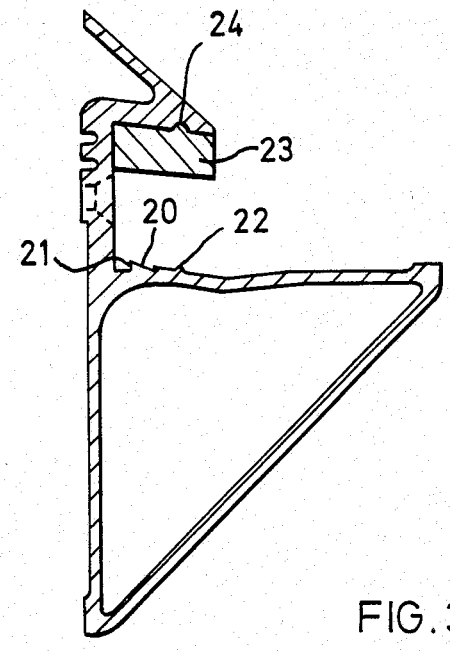
FIG. 3 is a vertical section through a second shelf support of the invention.

FIG. 3 illustrates four modifications any or all of which can be made to the shelf support.

According to a first modification, a second wedge zone 20 is provided to the rear of the first wedge zone 7, behind the step 8, the second wedge zone 20 terminating in a step 21. The rear edge of the second wedge zone 20 is higher than that of the first wedge zone 7, but the front lip 3 is raised so as to be at the same level as the rear edge of the second wedge zone 20. The retaining surface 10 is also higher so that the vertical distance between the front lip 3 and the edge part 11 is the same as in FIG. 2. It is found in this way that rather thicker shelves can be accommodated; the barb formed by the rear edge of the second wedge zone 20 digs in further, but only the very rear part of the shelf need be pushed past it.

According to a second modification, a small protrusion or barb 22 is provided in the wedge zone 7. This serves a purpose particularly when the shelf is long. One end can be pushed in beyond the small barb 22 and temporarily held while the other end is inserted—without the small barb 22, special care has to be taken to stop the first end coming out when the second end is inserted.

According to a third modification, the rearmost zone 9 can have a slight inclination, say about 5°, forwards and upwards.

According to a fourth modification, an elongate, uniform and continuous section insert 23 can be engaged under the retaining surface 10. The insert 23 has a rib 24 which engages in the respective groove 15. In effect, the underside of the insert 23 acts as the new retaining surface and a thinner shelf can be accommodated.

As a fifth modification, the support surface could be flat and horizontal, the wedge surface being on the front part of the retaining member whose underside would slope forwards and upwards from its lowermost part (11).

As a sixth modification, the rear edge of the first wedge zone 7 (FIG. 2) or of the second wedge zone 20 (FIG. 3) can be arranged to bend over or break off when an extra-thick shelf is inserted, thus allowing the shelf to be accommodated.

We claim:

1. A shelf support for engaging a rear portion of a rectangular section shelf having an underside and a top and holding said shelf as a cantilever, said shelf support being formed as an elongate member so that the support can extend along a substantial part of the length of a rear portion of said shelf, said shelf support comprising:

mounting means for mounting said shelf support on an upright surface, said mounting means having a rear surface for engaging said upright surfaces;

support means carried by said mounting means and comprising first and second support parts at substantially the same level for engaging a rear portion of said underside of said shelf, said second support part being spaced behind said first support part whereby said second support part is nearer said mounting means rear surface than is said first support part;

retaining means carried by said mounting means for engaging a rear portion of said top of said shelf, said retaining means having a downwardly extending lowermost retaining part which is spaced above said first and second support parts and positioned nearer said mounting means rear surface than said first support part but further from said mounting means rear surface than said second support part, said retaining part being movable upwards with respect to said support means by the application of only substantial vertical upwards force to said retaining part, said retaining means and said support means defining a gap for receiving and frictionally engaging said rear portion of said shelf; and wedge means having a wedge surface inclined forwardly at a small angle to the horizontal portion for engagement by said rear of said shelf, the vertical distance between the end of said wedge surface which is furthest from said mounting means rear surface and the opposite side of said gap being greater than the vertical distance between said retaining part and said first support part or said second support part, whereby when said shelf is pushed generally horizontally back towards said upright surface, wedging action of said wedge surface causes said retaining part to move upwardly with respect to said support means.

2. The shelf support of claim 1, wherein said retaining means comprises a retaining surface inclined forwards and downwards at a small angle to the horizontal.

3. The shelf support of claim 2, wherein said retaining surface is inclined at an angle of about 10° to the horizontal.

4. The shelf support of claim 1, wherein, between said first and second support parts, there is a dip defined by a dip zone and said wedge surface, both said dip zone and said wedge surface being defined on said support means and meeting at a large obtuse angle, said dip zone being inclined forwards and upwards at a small angle to the horizontal and said wedge surface being inclined forwards and downwards at a small angle to the horizontal.

5. The shelf support of claim 1, wherein said wedge surface is inclined at an angle of about 10° to the horizontal.

6. The shelf support of claim 4, wherein said dip zone is inclined at an angle of about 5° to the horizontal.

7. The shelf support of claim 4, wherein said support means defines the following zones, going from front to rear: a horizontal zone forming said first support part, a curved section transition zone, said dip zone, and a wedge zone forming said wedge surface, said transition zone forming a smooth curve between said horizontal zone and said wedge zone, and the rear edge portion of said wedge zone forming said second support part.

8. The shelf support of claim 4, wherein said wedge surface terminates in a step spaced from the rear of said support means, the said support means defining a rearmost part spaced below the level of the rear edge of said wedge surface.

9. The shelf support of claim 1, wherein there is a small protrusion on the wedge surface, for providing temporary retention of a partly inserted shelf.

10. In a shelf support formed as an elongate section and capable of supporting a shelf as a cantilever by the cooperation of: a supporting member to lie below and in contact with said shelf, said supporting member being disposed upon a plate for fixing to a wall; and a retaining member to lie above and in contact with said shelf, said retaining member being disposed upon said plate; the improvement comprising, locating a region of said retaining member, spaced from said plate, closer to said supporting member than a region of said retaining member adjacent said plate and providing a ramp surface to urge the retaining member upwards when the shelf is pushed generally horizontally back toward said plate, whereby the shelf is gripped between the supporting member and the retaining member and the supporting member is in contact with the shelf at at least a first location and at least a second location, said second location being closer to said plate than said first location.

11. The shelf support of claim 10, wherein there is a small protrusion on the ramp surface, for providing temporary retention of a partly inserted shelf.

12. The shelf support of claim 1, wherein said enlongate member is a continuous section of substantially uniform cross-section throughout.

13. The shelf support of claim 10, wherein said elongate section is of substantially uniform cross-section throughout.

14. An elongate shelf support for engaging a rear portion of a rectangular section shelf having an underside and a top, and holding said shelf as a cantilever, said shelf support being formed as an elongate member so that the support extends along a substantial part of the length of a rear portion of said shelf, said shelf support comprising:

mounting means for mounting said shelf support on an upright surface, said mounting means having a rear surface for engaging said upright surface, said mounting means also having a front surface which can engage the rear of said shelf;

support means carried by said mounting means and comprising first and second support parts at substantially the same level for engaging a rear portion of said underside of said shelf, said second support part being spaced behind said first support part whereby said second support part is nearer said mounting means rear surface than is said first support part; and retaining means carried by said mounting means for engaging a rear portion of said top of said shelf, said retaining means comprising a retaining surface inclined forwards and downwards at a small angle to the horizontal, said retaining surface being spaced above said first and second support means and having a lowermost retaining part which is positioned nearer said mounting means rear surface than said first support part but further from said mounting means rear surface than said second support part, said retaining part being movable upwards with respect to said support means by the application of only substantially vertical upwards force to said retaining part, said retaining means and said support means defining a gap for receiving and frictionally engaging said rear portion of said shelf, and said retaining means, said support means and said front surface of said mounting means defining a channel such that when said shelf is inserted in said channel with a forward edge thereof raised, and is pushed generally horizontally back towards said forward surface of said mounting means, a mechanical action is produced which causes said retaining surface to move upwardly with respect to said support means.

15. A shelf support for engaging a rear portion of a rectangular section shelf having an underside and a top, and holding said shelf as a cantilever, said shelf support comprising;

mounting means for mounting said shelf support on an upright surface, said mounting means having a rear surface for engaging said upright surface;

support means carried by said mounting means and comprising first and second support parts at substantially the same level for engaging a rear portion of said underside of said shelf, said second support part being spaced behind said first support part whereby said second support part is nearer said mounting means rear surface than is said first support part, there being between said first and second support parts a dip defined by a dip zone and a wedge surface, defined on said support means, said dip zone and said wedge surface meeting at a large obtuse angle, said dip zone being inclined forwards and upwards at a small angle to the horizontal and said wedge surface being inclined forwards and downwards at a small angle to the horizontal; and retaining means carried by said mounting means for engaging a rear portion of said top of said shelf, said retaining means comprising a retaining surface inclined forwards and downwards at a small angle to the horizontal, said retaining surface being spaced above said first and second support part, and said retaining surface having a lowermost, retaining part which is positioned nearer said mounting means rear surface than said first support part but further from said mounting means rear surface than said second support part, and above said wedge surface, the vertical distance between the said retaining part and the end of said wedge surface which is furthest from said mounting means rear surface being greater than the vertical distance between said retaining part and said first support part or said second support part such than when said shelf is pushed generally horizontally back towards said upright surface, the wedging action produced by said wedge surfaces causes said retaining part to move upwardly with respect to said support means.

* * * * *